US010196191B2

(12) United States Patent
Torrent Ortega

(10) Patent No.: US 10,196,191 B2
(45) Date of Patent: Feb. 5, 2019

(54) CLOSURE DEVICE FOR BOTTLES WITH EVIDENCE OF FIRST OPENING

(71) Applicant: COMPAÑÍA DE TAPONES IRRELLENABLES, S.A., Puerto de Santa María-Cádiz (ES)

(72) Inventor: David Torrent Ortega, Puerto de Santa María-Cádiz (ES)

(73) Assignee: COMPAÑÍA DE TAPONES IRRELLENABLES, S.A., Puerto de Santa Maria-Cádiz (ES)

( * ) Notice: Subject to any disclaimer, the term of this patent is extended or adjusted under 35 U.S.C. 154(b) by 0 days.

(21) Appl. No.: 14/902,949

(22) PCT Filed: Jul. 4, 2014

(86) PCT No.: PCT/EP2014/064321
§ 371 (c)(1),
(2) Date: Jan. 6, 2016

(87) PCT Pub. No.: WO2015/001084
PCT Pub. Date: Jan. 8, 2015

(65) Prior Publication Data

US 2016/0347520 A1 Dec. 1, 2016

(30) Foreign Application Priority Data

Jul. 5, 2013 (EP) ..... 13382276

(51) Int. Cl.
*B65D 49/02* (2006.01)
*B65D 50/00* (2006.01)
(Continued)

(52) U.S. Cl.
CPC ..... *B65D 55/026* (2013.01); *B65D 47/123* (2013.01); *B65D 49/02* (2013.01); *B65D 2101/00* (2013.01); *B65D 2101/0023* (2013.01)

(58) Field of Classification Search
CPC ..... B65D 55/026; B65D 55/066; B65D 2101/00; B65D 2101/0023; B65D 49/02;
(Continued)

(56) References Cited

U.S. PATENT DOCUMENTS 2,201,791 A * 5/1940 Samburg ..... B65D 55/02 215/230
3,335,889 A * 8/1967 Brumme ..... B65D 41/348 215/252
(Continued)

FOREIGN PATENT DOCUMENTS

CA 2618337 A1 7/2009
EP 2178771 B1 9/2011

OTHER PUBLICATIONS

European Search Report, dated Oct. 30, 2013.
International Search Report, dated Aug. 22, 2014.

*Primary Examiner* — J. Gregory Pickett
*Assistant Examiner* — Gideon Weinerth
(74) *Attorney, Agent, or Firm* — Tristan A. Fulerer; Olive Law Group, PLLC

(57) ABSTRACT

The present invention relates to a closure device for bottles with evidence of first opening where before the first opening the closure shows a capsule with a perimetral line, and after the first opening, a separation line visually evidencing said first opening now appears where the perimetral line was previously located.

14 Claims, 2 Drawing Sheets

(51) Int. Cl.

| | |
|---|---|
| ***B65D 41/32*** | (2006.01) |
| ***B65D 51/20*** | (2006.01) |
| ***B65D 55/02*** | (2006.01) |
| ***B65D 47/02*** | (2006.01) |
| ***B65D 47/12*** | (2006.01) |

(58) Field of Classification Search

CPC .. B65D 47/123; B65D 43/0283; B65D 41/34; B65D 55/028; B65D 55/022; B65D 41/348; B65D 2251/0015; B65D 2251/0078; B23P 11/00

USPC ..... 215/258, 252, 262, 232; 220/266, 259.4; 40/311

See application file for complete search history.

(56) References Cited

U.S. PATENT DOCUMENTS 3,348,718 A * 10/1967 Musy ..... B65D 41/348 215/252
3,455,479 A * 7/1969 Wilton ..... B65D 41/348 215/252
3,850,328 A * 11/1974 Guala ..... B65D 41/3409 215/252
5,131,549 A * 7/1992 Battegazzore ..... B65D 41/38 215/252
6,276,544 B1 * 8/2001 Battegazzore ..... B65D 41/62 215/252
6,454,126 B1 * 9/2002 Battegazzore ..... B65D 41/3447 215/230
6,619,492 B2 * 9/2003 Battegazzore ..... B65D 49/04 215/21
6,908,013 B2 * 6/2005 Thomson ..... B65D 49/04 215/251
6,981,600 B1 * 1/2006 Battegazzore ..... B65D 41/3442 215/230
7,121,419 B2 * 10/2006 Ferry ..... B65D 49/06 215/258
7,922,019 B2 * 4/2011 Granger ..... B21D 51/50 215/21
8,281,944 B2 * 10/2012 Battegazzore ..... B65D 41/3428 215/219
8,453,856 B2 * 6/2013 Skelton ..... B65D 55/022 215/230
8,522,991 B2 * 9/2013 Skelton ..... B65D 41/0478 215/21
8,844,770 B2 * 9/2014 Jourdin ..... B05B 11/3049 215/274
9,102,448 B2 * 8/2015 Skelton ..... B65D 49/04
9,694,948 B1 * 7/2017 Pakhomov ..... B65D 41/38
2005/0115915 A1 * 6/2005 Thomson ..... B65D 49/04 215/252
2006/0113272 A1 * 6/2006 Rodriguez ..... B65D 41/3419 215/252
2008/0264893 A1 * 10/2008 Battegazzore ..... B65D 41/0492 215/252
2009/0166313 A1 * 7/2009 Fabiano ..... B65D 49/04 215/316
2009/0289027 A1 * 11/2009 Torrent Ortega .... B65D 41/348 215/352
2010/0170898 A1 * 7/2010 Skelton ..... B65D 55/022 220/214
2010/0308054 A1 * 12/2010 Goria ..... B65D 41/62 220/315
2013/0276413 A1 * 10/2013 Kurmis ..... B65D 41/0435 53/484
2014/0048537 A1 * 2/2014 McPherson ..... B65D 49/04 220/276
2014/0054288 A1 * 2/2014 McPherson ..... B65D 41/34 220/255.1
2014/0183195 A1 * 7/2014 McPherson ..... B65D 49/04 220/266
2015/0274387 A1 * 10/2015 Torrent Ortega .... B65D 47/043 215/253
2015/0298876 A1 * 10/2015 McPherson ..... B65D 41/348 215/200
2016/0060007 A1 * 3/2016 McPherson ..... B65D 41/28 220/259.3
2016/0068311 A1 * 3/2016 McPherson ..... B65D 41/34 220/214
2018/0072474 A1 * 3/2018 Torrent Ortega .... B65D 47/123

* cited by examiner

CLOSURE DEVICE FOR BOTTLES WITH EVIDENCE OF FIRST OPENING

CROSS-REFERENCE TO RELATED APPLICATIONS

This application is filed under the provisions of 35 U.S.C § 371 and claims the priority of international Patent Application No. PCT/EP2014/064321 filed on 4 Jul. 2014 entitled "CLOSURE DEVICE FOR BOTTLES WITH EVIDENCE OF FIRST OPENING" in the name of David TORRENT ORTEGA, which claims priority to European Patent Application No. 13382279.7 filed on 5 Jul. 2013, both of which are hereby incorporated by reference herein in their entirety.

OBJECT OF THE INVENTION

The present invention relates to a closure device for bottles with evidence of first opening where before the first opening the closure shows a capsule with a perimetral line, and after the first opening, a separation line visually evidencing said first opening now appears where the perimetral line was previously located.

BACKGROUND OF THE INVENTION

It is convenient for closure device for bottles intended for containing highly valuable liquids such as liquors to have means that prevent tampering with their content.

Among the means that prevent tampering are means which prevent refilling the content with less valuable liquids and also means evidencing the first opening. These second means prevent an already opened bottle from being able to be passed off as a new bottle. These means evidencing the first opening are mainly visual means even though they can also be acoustic means, for example, by breaking breakable bridges.

Examples of visual means are the means evidencing a different appearance before and after the first opening. Particularly, a way to evidence the first opening is to show a band having a color different from that of the capsule initially covering the closure.

This is the case of European Patent number EP2178771B1. This patent describes a closure which uses a composite cap in which two parts interact. One part is a threaded part having ramps on the upper portion; and the other part covering the first part has one or more thread followers as well as projections supported on the ramps. The relative sliding movements imposed by the thread and the ramps is helical, i.e., an axial movement driven by the mutual rotation between the parts applied in order to unscrew the closure. Both the thread and the ramps located on the upper surface of the cap have a broken end such that upon reaching the end of travel according to the helical movement, one part is irreversibly locked with respect to the other part by an axial downward movement.

Even though one part drops slightly with respect to the other part, this recovery in the axial position is not complete such that a mutual separation is maintained. This mutual separation is how the first opening is evidenced.

The configuration of the parts to be manufactured is complex and requires an assembly in which the relative orientation between both parts is taken into account so that they fit together in their first position. Likewise, the drop which irreversibly locks both parts can give rise to an unwanted clearance once the closure has been opened.

The present invention proposes an alternative structure in the closure which likewise evidences the first opening by means of a separation between sections of said closure; nevertheless, it provides a simpler, clearance-free configuration the manufacture of which is less complex, solving the aforementioned problems.

DESCRIPTION OF THE INVENTION

The closure for bottles is a closure with evidence of first opening suitable for being installed on the mouth of the bottle on which the safety means are to be installed.

Once installed, the closure has a first appearance, and after the first opening, the closure becomes slightly higher due to the separation of two of its components. The separation allows viewing a perimetral area which was hidden before the first opening. If this area further has a color or a differentiating appearance, the visual evidence is greater.

The neck of the bottle, in addition to being the element on which the closure is installed, will serve as a positional reference for the rest of the components since it extends along a longitudinal direction X-X'.

The closure according to a first aspect of the invention comprises:

- a pourer:
  - extending towards the lower portion, i.e., towards where the bottle is located according to the longitudinal direction X-X', by means of a lower cylindrical skirt, intended for being located in an operative position coaxial with the neck of the bottle, and where this skirt has fixing means for fixing with the neck of the bottle, and
  - comprising a threaded section;
- a cap:
  - having a threaded inner section with a thread complementary to that of the threaded section of the pourer such that screwing and unscrewing said cap gives rise to a rotation about the longitudinal direction X-X' and to an axial movement also along the same longitudinal direction X-X', The pourer and the cap are the two components which separate from one another to evidence the first opening. The pourer is the part which is integral with the bottle by means of the fixing means it has, which are intended for being fixed on the neck of the bottle, and the cap is the part which is separated by means of screwing the pourer.

Opening by means of unscrewing the cap causes rotation plus axial movement. This axial movement, regardless of whether rotation occurs, is prevented by means of a third part, which will be called a locking part, from a certain axial position when it is again screwed onto the pourer after the first opening.

In other words:

- the closure additionally comprises a locking part that can be moved axially according to the longitudinal direction X-X', having a temporary retaining section temporarily immobilizing said locking element with the pourer.

The locking part has a temporary mechanical link with the pourer. The locking part can be moved axially with respect to the cap. In one embodiment, the axial movement is a sliding and guiding movement. In the preferred example, this guiding movement is by means of a wedged perimetral flange exerting pressure on the inner face of the cap.

With respect to the cap the link is a temporary retaining link, i.e., the locking part is integral with the pourer until a large enough force separates them. In one embodiment, they are made integral with one another by means of friction through sufficient press fit.

This locking part additionally verifies that:

the inner surface of the cap has a wedge such that it allows the locking part to overcome the wedge through the axial movement of the locking part during first opening according to the longitudinal direction X-X', but prevents the passage thereof in the opposite direction such that once the locking part overcomes the wedge, the closure of the cap by screwing onto the pourer occurs with a mutual separation between the cap and the pourer that is greater than that established before the first opening.

The first opening separates the cap from the pourer. The locking part has a link temporarily retaining it, making it integral with the pourer. Since the movement of the locking part relative to the cap is not prevented, it moves down with respect to the cap, even overcoming the wedge on the inner surface the cap. In one embodiment, the locking part has guiding means for sliding along the inner face of the cap. Even in this case, the retention between the locking part and the pourer is greater than the force exerted by the wedge to be overcome and the friction of the guiding means.

After overcoming the wedge, the adopted configuration is irreversible, i.e., the locking part is prevented by the wedge from returning to its initial position with respect to the cap.

According to one embodiment, once the locking part overcomes the wedge the axial movement progresses until the locking part is supported on the inner thread of the cap, so the upward movement of the cap after having overcome the wedge means that the temporary link between the locking part and the pourer disappears.

According to another embodiment, there may be a projection on the inner face of the cap such that said projection and not the inner thread is what stops the movement of the locking part.

The lowered position of the locking part with respect to the cap means that the initial position cannot be recovered when the cap is again screwed on the pourer, but rather the locking part will abut with the pourer in a higher axial position according to the longitudinal direction X-X' such that there is a gap between the cap and the pourer. This gap leaves a perimetral area which was not visible before the first opening visually accessible. This visual access evidences the first opening.

DESCRIPTION OF THE DRAWINGS

These and other features and advantages of the invention will be more clearly understood from the following detailed description of a preferred embodiment given only by way of non-limiting illustrative example in reference to the attached drawings.

DETAILED DESCRIPTION OF THE INVENTION

According to the first inventive aspect, the present invention relates to a closure for bottles with evidence of first opening. The closure is intended for being installed in the neck of a bottle which defines the longitudinal direction X-X' and which will correspond to the axial direction of the closure.

Figure 2:
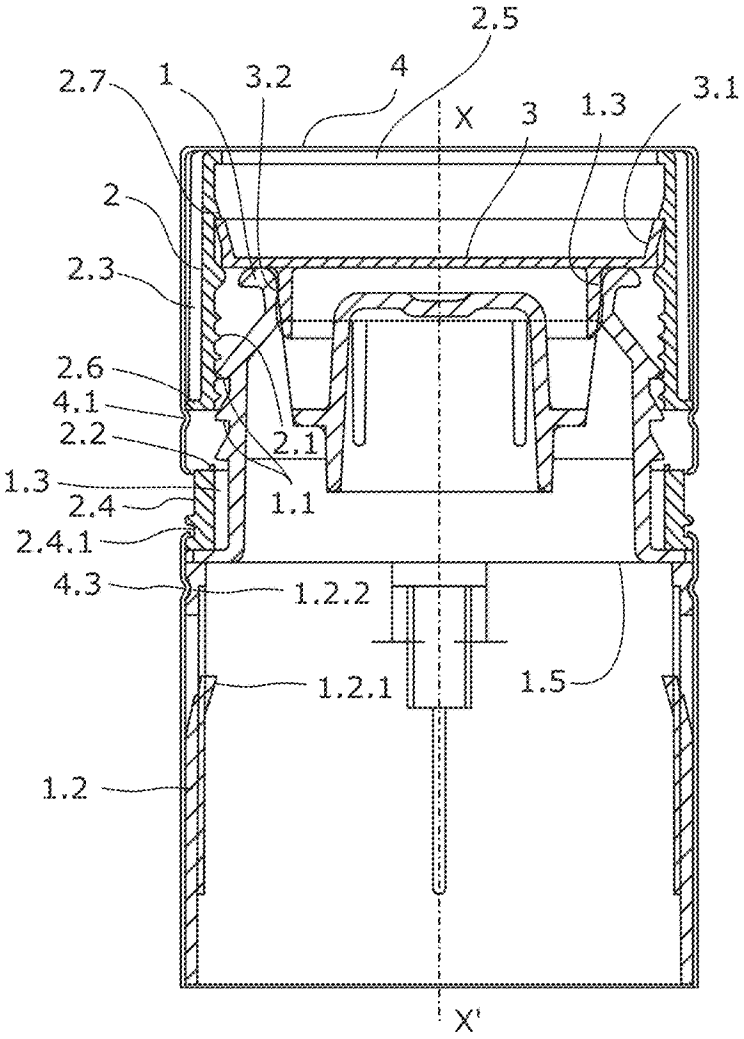
FIG. 2 shows the cross-section of the preceding figure after having carried out a first opening.
Figure 1:
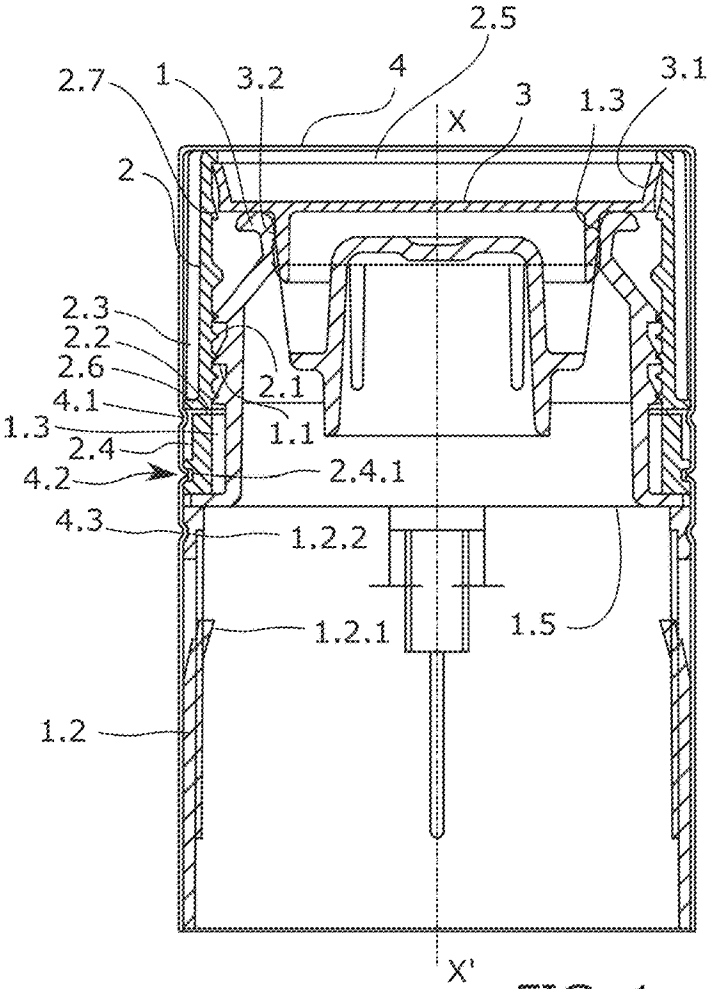
FIG. 1 shows a cross-section of an embodiment of the closure before the first opening.

The closure according to the preferred embodiment comprises a pourer (1) and a cap (2). FIGS. 1 and 2 show respective cross-section of the closure before and after the first opening. The pourer (1) formed by a lower cylindrical section (1.2) in the form of a skirt covering the end of the neck of the bottle, not shown in the figure for the sake of clarity, is identified in these sections.

The lower cylindrical section (1.2) has windows below which there are fixing elements (1.2.1) intended for allowing insertion of the pourer (1) on the neck of the bottle but they prevent it from coming out. These fixing means (1.2.1) are in the form of a flexible oblique extended strip to allow wedging and being supported on a perimetral projection of the neck of the bottle.

The pourer has a base (1.5) intended for being supported on the mouth of the bottle, and on this base (1.5) the pourer (1) prolongs upwards by means of an essentially cylindrical body ending in a pourer edge (1.3). The positional terms in the description such as upper and lower are understood as referring to the orientation shown by the drawings. In this case, upper and lower are understood according to the longitudinal direction X-X', the end where the bottle is located being the lower position.

A section of the upper cylindrical body of the pourer (1) is threaded (1.1) where this thread is complementary to the thread (2.1) of the cap (2) intended for covering the pourer (1). Screwing and unscrewing the cap (2) gives rise to a relative axial movement in addition to the rotation component.

In this embodiment, the cap (2) prolongs towards the lower portion by means of a ring (2.4) initially linked to the cap (2) by means of breakable bridges (2.2). On the outer portion, this ring (2.4) has two parallel perimetral projections between which there is a perimetral notch (2.4.1).

In this embodiment, the closure is covered by a capsule (4) covering, in the lower portion, the entire skirt (1.2) of the pourer (1).

In this embodiment, the capsule (4) is an aluminum sheet body formed by a cylindrical body surrounding the closure and an upper base covering the upper surface of the cap (2).

The capsule (4) shows a perimetral cut (4.2) made by means of a blade which, in addition to making the cut, produces the notch of the two lips generated in the cut, leaving them housed adjacent to one another in the perimetral notch (2.4.1) of the ring (2.4) of the cap (2).

This perimetral cutting of the capsule (4) gives rise to two sections of capsule (4), the upper section integral with the cap (2) and the lower section integral with the skirt (1.2) of the pourer (1).

The cap (2) has in its lower portion, above the breakable bridges (2.2) linking the ring (2.4), a perimetral projection (2.6) below which a first notch of the upper section of the capsule (4) is located. The combination of the perimetral projection (2.6) and the notch of the upper section of the capsule (4) cause the cap (2) to be coaxially integral with said upper section of the capsule (4).

The cylindrical side face of the cap (2) has vertical ribs (2.3) aiding the retention against rotation between the capsule (4) and the cap (2).

Likewise, the skirt (1.2) of the pourer (1) has a perimetral recess (1.2.2) housing a second notch of the lower section of the capsule (4). The combination of the perimetral recess (1.2.2) of the skirt (1.2) of the pourer (1) and the notch of the lower section of the cap (4) cause the skirt (1.2) to be coaxially integral with said lower section of the capsule (4).

Additionally, the lip generated by the perimetral cut (4.2) of the capsule (4) in the lower section of the capsule (4) permanently fixes the ring (2.4) of the cap to the pourer (1).

The first opening of the cap (2) thus generates rotation and also axial movement. This axial movement of the cap (2) is not followed by the ring which is retained by the upper lip of the lower section of the capsule (4), causing breakable bridges (2.2) temporarily linking it to the cap (2) to break. This breaking produces acoustic evidence of the first opening.

FIGS. 1 and 2 also show a locking part (3). According to this embodiment, the locking part (3) is formed by a disc-shaped body arranged perpendicular to the longitudinal direction X-X'. The disc has a cylindrical section on its lower surface forming the temporary retaining section (3.2) and extending coaxial to the pourer (1) such that this lower temporary retaining section (3.2) enters by press fit, being supported on the inner surface of the pourer edge (1.3).

The perimetral edge of the locking part (3) extends by means of a perimetral flange (3.1) configured in a conical section, i.e., a flexible oblique section supported on the inner face of the cap (2) is shown in a section view. The function of this perimetral flange (3.1) is to guide the axial movement of the locking part (3) and also to improve locking as described below.

The perimetral flange (3.1) is configured to be flexible. The inner face of the cap (2) comprises a wedge (2.7) which also extends along the perimeter such that the locking part (3) reaches this wedge (2.7) in its axial movement when opening the cap (2). The flexibility of the perimetral flange (3.1) allows the locking part (3) to overcome the wedge (2.7). The flexible recovery of the perimetral flange (3.1) means that it will be supported on the wedge (2.7), preventing axial movement in the reverse direction. This support is shown in FIG. 2.

In said FIG. 2, axial movement has been achieved such that the perimetral flange (3.1) irreversibly overcomes the wedge (2.7) such that the cap (2) is no longer capable of again moving down the distance it has moved up imposed by the position of the wedge (2.7). If the axial movement continues beyond the position shown in FIG. 2, the upward movement of the cap (2) means that the locking part (3) abuts with the internal thread of the cap (2) causing the temporary retaining section (3.2) to separate from the locking part (3) and the inner surface of the pourer edge (1.3) since the retention by friction between both elements (3.2, 1.3) is overcome.

Therefore, FIG. 2 also corresponds to the situation resulting from closing the cap (2) again after the first opening where the locking part (3) moves down until its temporary retaining section (3.2) again enters the inner surface of the pourer edge (1.3) favoring a leak-tight closure preventing the liquid from coming out.

The upward movement of the cap (2) also entails the upward movement of the upper section of the capsule (4) which is integral with the cap (2). This upward movement causes the lower lip of the upper section of the capsule (4) which is housed in the notch (4.2) of the ring (2.4) of the cap (2) to come out of said housing. In FIG. 2, the position in height according to the axial direction of the lower lip of the upper section of the capsule (4) is such that it does not expose the entire ring (2.4). Therefore, if the ring (2.4) has a color different from the color of the capsule (4), visual evidence of the first opening is very obvious.

Figures 3, 4, 5:
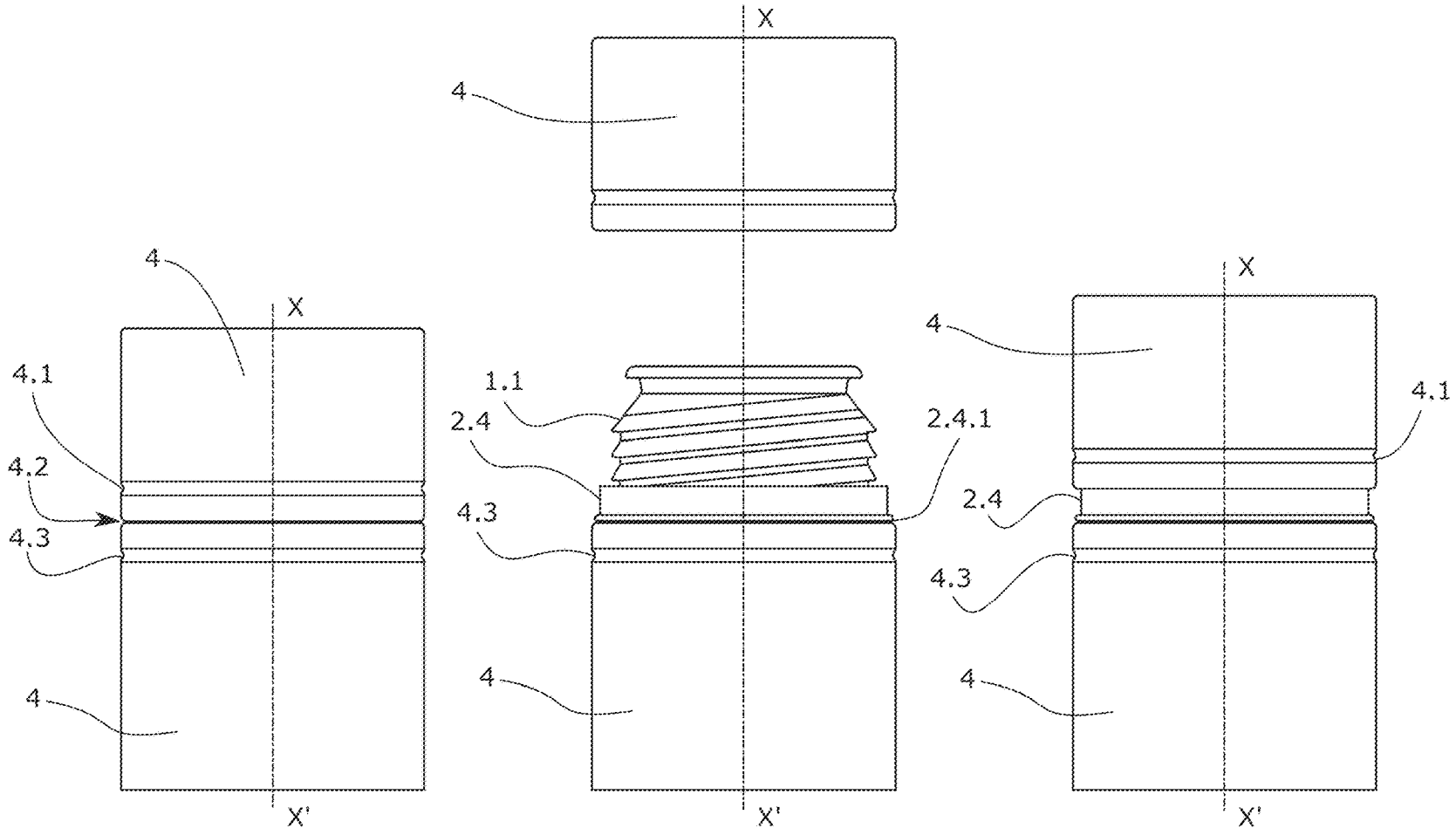
FIG. 3 shows the embodiment of the preceding figures showing the outer appearance before the first opening.
FIG. 4 shows the closure of the preceding figure after having completely separated the cap from the closure.
FIG. 5 shows the closure of the preceding figure after screwing the cap of the closure on again, being slightly moved away such that the first opening is evidenced.

FIGS. 3, 4 and 5 show the outer appearance sequence of the closure before the first opening, FIG. 3, with the closure completely open, FIG. 4; and, when it is screwed on again to the height allowed by the locking part, FIG. 5, leaving the ring (2.4) in view.

If this ring did not exist, the gap would allow visual access to the section of the pourer (1) coinciding with the window left by the gap imposed by the locking part (3).

The locking part (3) has axial symmetry so it can be positioned in any orientation during manufacture, facilitating the manufacture and assembly.

The locking occurs when the wedge (2.7) is overcome. In this embodiment, a flexible perimetral flange (3.2) is what overcomes the wedge (2.7) so the locking does not require a reverse "falling" movement such as in the state of the art that gives rise to clearances after the first opening.

As shown in FIGS. 1 and 2, the cap (2) has a window (2.5) on its upper portion. If the capsule is transparent or if it also has another window, the locking part (3) is visually exposed. In this case, the change in relative position with respect to the cap (2) after the first opening, a slightly lowered position, is additional visual evidence of this first opening.

The invention claimed is:

1. A closure device for a bottle, with evidence of a first opening, wherein the bottle comprises a mouth and a neck, wherein the neck extends along a longitudinal direction X-X' of the bottle, wherein said closure device is installed on the mouth of the bottle and comprises:

a pourer (1) comprising a threaded section (1.1), a pourer edge (1.3), and a cylindrical skirt (1.2), wherein the pourer is inserted in, and is coaxial with, the neck of the bottle, and a cap (2) having a threaded inner section (2.1) with a thread complementary to that of the threaded section (1.1) of the pourer (1) such that screwing and unscrewing said cap (2) gives rise to a rotation about, and an axial movement along, the longitudinal direction X-X', wherein the closure device further comprises a locking part (3) housed within the cap (2), wherein the locking part (3) is in a first position before first opening and can be moved axially with respect to the cap (2), along the longitudinal direction X-X', the locking part (3) having a retaining section (3.2) that can enter and be retained on the pourer edge (1.3) by friction between the retaining section (3.2) and the pourer edge (1.3) until a large enough force separates the retaining section (3.2) from the pourer edge (1.3); and, an inner surface of the cap (2) has a wedge (2.7) such that the axial movement of the locking part (3) relative to the cap (2) along the longitudinal direction X-X' during first opening allows the locking part (3) to overcome the wedge (2.7) to a second position, but, after overcoming the wedge (2.7), the locking part (3) is prevented by the wedge (2.7) from passing from the second position back to the first position with respect to the cap (2), wherein after the first opening, any closure of the cap (2) by screwing onto the pourer (1) results in a separation between the cap (2) and the cylindrical skirt (1.2) of the pourer (1) that is greater than that established before the first opening.

2. The closure device according to claim 1, wherein said closure device additionally comprises a capsule (4) for covering the cap (2) and at least part of the cylindrical skirt (1.2) of the pourer (1), where before the first opening, this capsule (4) shows two adjacent sections along a perimetral separation line (4.2); a first section of the capsule (4) covering the lower cylindrical skirt (1.2) of the pourer and a second section of the capsule (4) covering the cap (2).

3. The closure device according to claim 2, wherein the cap (2) further comprises a perimetral ring (2.4), wherein after the first opening, the ring (2.4) is permanently fixed to the pourer (1) and the ring (2.4) is visually accessible between the cap (2) and the cylindrical skirt (1.2) of the pourer (1), as evidence of said first opening.

4. The closure device according to claim 3, wherein prior to the first opening, the ring (2.4) is attached to the cap (2) by a bridge (2.2) that is broken during the first opening.

5. The closure device according to claim 2, wherein the separation line (4.2) of the capsule (4) is either a weakening line or a cutting line.

6. The closure device according to claim 2, wherein the capsule (4) covering the cap (2) is axially retained to the cap (2) using a perimetral tab (2.6) and a first notch (4.1).

7. The closure device according to claim 2, wherein the capsule (4) covering the cap (2) is retained against rotation using a plurality of vertical grooves (2.3) on an outer surface of the cap (2) on which the capsule (4) is tightly fitted.

8. The closure device according to claim 1, wherein the cap (2) further comprises a window (2.5) with visual access to the locking part (3) for identifying the second position of said locking part (3) after the first opening, establishing double visual evidence of the first opening.

9. The closure device according to claim 1, wherein the locking part (3) has an axial guiding element (3.1) that can slide along the inner surface of the cap (2) such that this guiding element (3.1) overcomes the wedge (2.7) during first opening and after overcoming the wedge (2.7) is prevented by the wedge (2.7) from axial movement from the second position back to the first position.

10. The closure device according to claim 9, wherein the guiding element (3.1) of the locking part (3) is an outer perimetral flange that can slide along the inner surface of the cap (2) by friction.

11. The closure device according to claim 10, wherein the guiding element (3.1) defines a conical sector.

12. The closure device according to claim 9, wherein the retaining section (3.2) is a cylindrical section that can be press fitted into the pourer edge (1.3), and where the friction between the retaining section (3.2) of the locking part (3) and the pourer edge (1.3) is such that the axial retention resulting between them is greater than the friction between the guiding element (3.1) and the inner surface of the cap (2) until enough force separates the retaining section (3.2) from the pourer edge (1.3).

13. The closure device according to claim 1, wherein between the locking part (3) and the cap (2) there is axial guiding and friction allowing both movement according to the longitudinal direction X-X' and relative rotation between both parts (2, 3).

14. The closure device according to claim 1, wherein the locking part (3) has axial symmetry.

* * * * *